United States Patent [19]

Arai

[11] 3,933,360

[45] Jan. 20, 1976

[54] SKI

[76] Inventor: Fusaji Arai, 4940, Oaza-Ohmachi, Ohmachi, Nagano, Japan

[22] Filed: Jan. 2, 1975

[21] Appl. No.: 537,938

[52] U.S. Cl. ..... 280/11.13 S

[51] Int. Cl.[2] ..... A63C 5/04

[58] Field of Search .....280/11.13 S, 11.13 T, 280/11.13 F, 11.13 R, 28, 12 AA, 12 R, 18; 9/310 A, 310 D, 310 R

[56] References Cited

UNITED STATES PATENTS 3,284,823 11/1966 Steffel ..... 9/310 A

FOREIGN PATENTS OR APPLICATIONS 1,445,762 6/1966 France ..... 280/11.13 S 238,074 1/1965 Austria ..... 280/11.13 S

*Primary Examiner*—Kenneth H. Betts

*Assistant Examiner*—David M. Mitchell

[57] ABSTRACT

A ski including at least a body and a top bend portion extending from one end of said body, said top bend portion being provided with a plurality of air holes passing through said top bend portion from the front to the back surface thereof and allowing air flow to pass therethrough in gliding of said ski.

4 Claims, 8 Drawing Figures

SKI

The present invention relates to a ski which can increase gliding speed by preventing wind resistance in gliding, and more particularly to a ski suitable for a downhill race in which considerable speed is required.

In a downhill race, a speed above 150 km/hour is required. In gliding at such a high speed, a ski is severely rocked due to uneven snow surface and wind pressure effect applied to top bend portion of the ski, thus bringing the skier in an uneasiness and a fear. Especially, the effect of wind pressure applied to the top bend portion not only puts a psychological burden on a skier but also lowers the gliding speed of a ski, the latter being the most serious obstacle to a downhill race. When high wind pressure is applied on a top bend portion of a ski, said wind pressure effects pushing said top bend portion upwardly due to the curved shape thereof, thereby raising the front portion of the ski away from the snow surface, said raising of the front portion causing the ski to rock and shake. Rocking or shaking of a ski naturally results in the increase of wind resistance applied to the skis and the skier, thereby decreasing gliding speed of the ski and at the same time bringing the skier into a fear, so that the skier cannot make a good record.

Conventionally, in order to overcome these problems, it has been tried to attach a spoiler (wing) or a weight or the like to a ski. However, spoilers are forbidden in a formal skiing race while weights do not have much effect.

From the abovementioned standpoint, the object of the present invention is to provide a ski by which raising up of said ski from snow surface which is caused by wind resistance applied on the top bend portion of said ski in gliding is prevented, and therefore gliding speed can be increased.

In order to achieve this object, a ski according to the present invention includes at least a body with a suitable length and a top bend portion integrally extending upwardly and forwardly from one end of said body, said top bend portion being provided with a plurality of air holes passing through said top bend portion from the front to the back surface thereof and allowing air flow to pass therethrough in gliding of said ski. Said holes preferably extends from the front to the back of said top bend portion in parallel with the longitudinal axis of said body or with the plane to contact with snow surface, but it may extend at an upward or downward slope from the front to the back of said top bend portion.

According to a ski of the present invention, in gliding of said ski, air in front of a top bend portion passes through said holes, and said air having past therethrough contacts with air above the top bend portion which does not have past through said holes, so that swirling wind is formed. Said swirling wind pushes down the front portion of the ski, thereby ensuring the sufficient contact of said front portion with snow surface or preventing raising of said front portion away from snow surface, whereby the ski is prevented from shaking and rocking.

The number of such air holes varies more or less in relation to the size of a ski (width, thickness, length or the like), but preferable is about 12 per 20 $cm^2$ of imaginary area of a ski seen above snow surface when the ski is seen from the front.

The size of each hole varies more or less in accordance with the strength and the size of the ski, but normally it is 5 – 10 mm.

The present invention relates to a ski including at least a body and a top bend portion, and of course, it relates to a ski provided with a rear bend portion in addition to these body and top bend portion.

Further, the present invention can be applied to any one of skis the bodies of which are made of wood, plastics, metal or their combination. In other words, holes for preventing raising of a ski according to the present invention can be provided in a top bend portion thereof made of any one of wood, plastics, metal and their combination.

Other features and advantages of the present invention will be apparent from the following description of a variety of embodiments of the present invention given with reference to the appended drawings in which.

Figure 1:
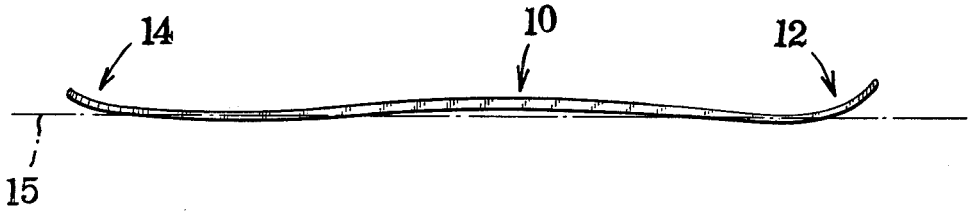
FIG. 1 is a side view of an embodiment of a ski according to the present invention.
Figure 2:
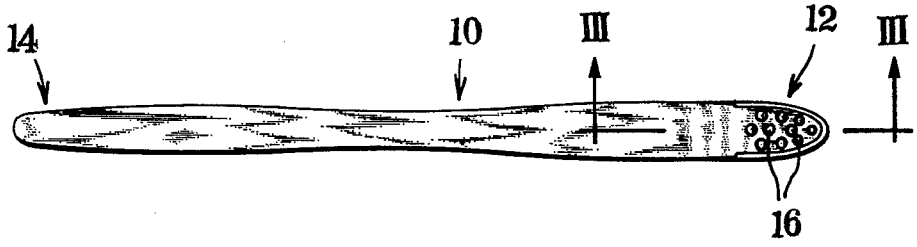
FIG. 2 is a plan view of the ski of FIG. 1.

Referring to FIGS. 1 and 2, shown is an embodiment of a ski according to the present invention, which comprises a body 10, a top bend portion 12 forwardly and upwardly extending integrally from one end of said body 10 and a rear bend portion 14 integrally extending from the other end of said body 10 and forming a slight rearward curvature.

The top bend portion 12 is provided with a plurality of cylinder-shaped holes 16, each hole 16 passing through the top bend portion 12 from the front surface 12*a* to the back surface 12*b* and extending in parallel with the longitudinal axis 15 of the body 10 of the ski (namely, the axis of each hole 16 is parallel with the axis 15 of the body 10 of the ski). In this case, the ski is disposed with its longitudinal axis being in parallel with snow surface S.

In using a ski provided with such holes 16 in a top bend portion and especially in gliding at high speed, air flow $A_1$ in front of the top bend portion 12 is introduced into the holes 16 in large part, and the air flow $A_1$ having passed through said holes 16 comes in contact with air flow $A_2$ not having past through the holes but past above the top bend portion 12 in the front portion of the ski or the fore part of the body 10 so that the air flow $A_1$ becomes whirling wind $A_1'$.

Said whirling wind has an effect of pushing down the upper surface of the front portion of the ski, so that the front portion is not raised away from snow surface S but contacts appropriately with snow surface. Therefore, the ski in gliding is prevented from shaking and rocking so that the skier is free from uneasiness and fear thus affording to sufficiently increasing gliding speed of the ski.

Figure 5:
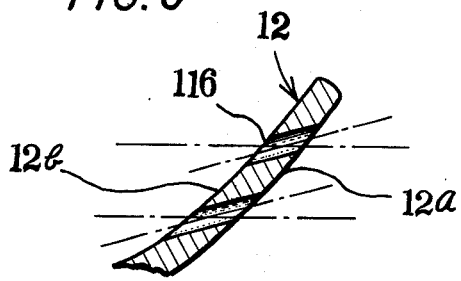
FIGS. 5 and 6 are sections of modifications of air holes shown in FIG. 3.
Figure 6:
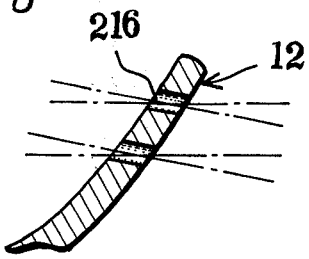

In FIG. 5, shown are cylinder-shaped air holes 116 extending at a slight downward slope with respect to the longitudinal axis of a body of a ski from the front surface 12*a* to the back surface of the top bend portion. In FIG. 6 shown are cylinder-shaped air holes 216 extending at a slight upward slope with respect to the longitudinal axis of the body of a ski. If the slope of such air holes 116 or 216 is too steep, air flow cannot pass through the holes in gliding.

Figure 3:
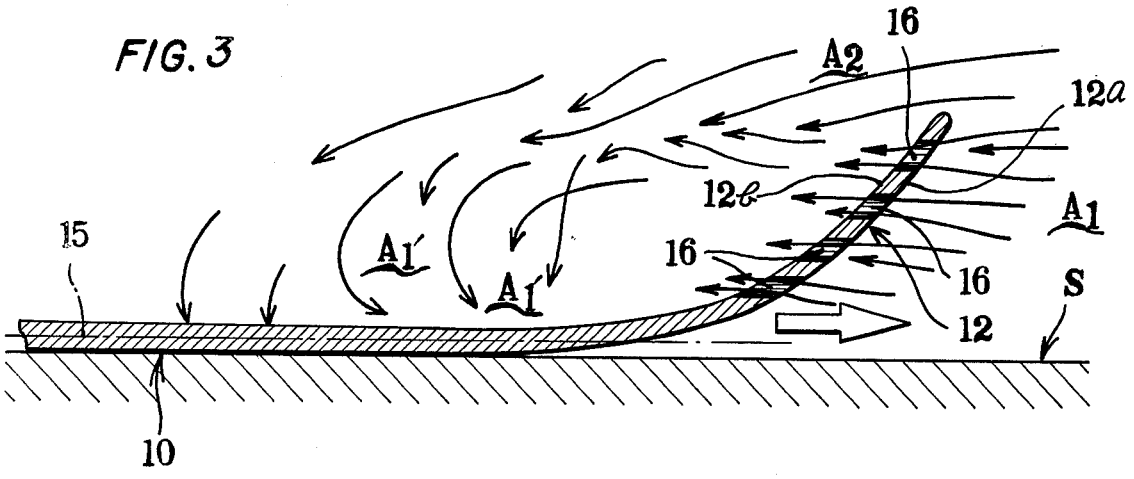
FIG. 3 is an enlarged section taken along the line III — III of FIG. 2.
Figure 4:
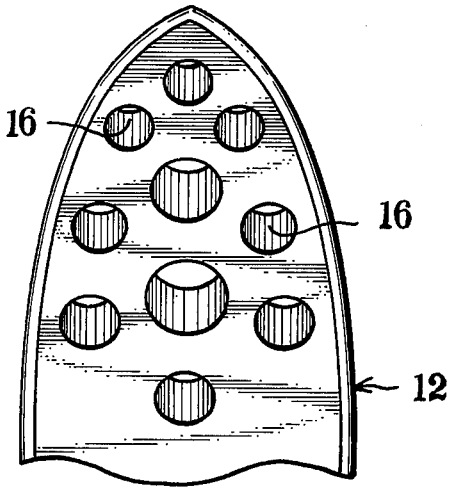
FIG. 4 is a partly enlarged plan view of the ski of FIG. 2.
Figure 7:
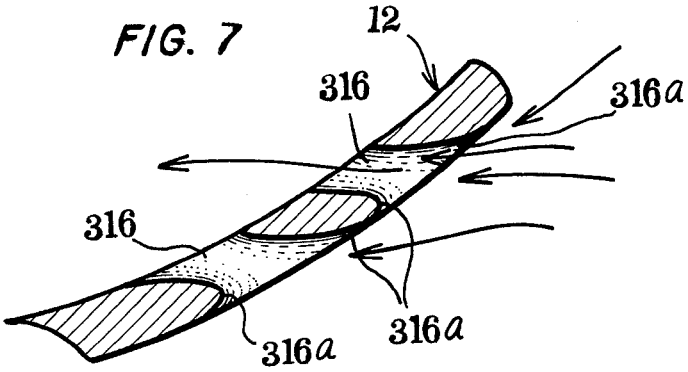
FIGS. 7 and 8 are sections of another embodiments of a ski according to the present invention.

In FIG. 7, shown are air holes 316 which are modifications of the holes illustrated in FIG. 3. Each of said air holes is provided with a guide edge portion 316a for improving suction of air flow received by the outer surface of the top bend portion and for preventing snow from attaching to the entrance of the hole.

Figure 8:
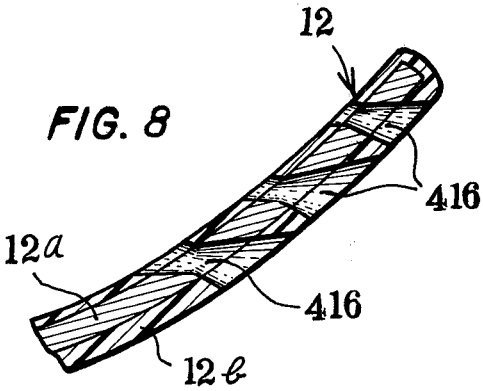

Further, as shown in FIG. 8, a substantially Y-sectioned hole 416 with an enlarged entrance can have more remarkable effects of air flow suction and prevention of snow attachment.

The shape in section of an air hole according to the present invention is most preferably a circle but not limited thereto and may be an ellipse, a rectangle, polygon or the like. Further, such a hole is adapted to pass through the top bend portion without concern with its structure such as a simple (FIG. 1 or FIG. 2) or a composite (e.g. FIG. 6) structure. For example, the top bend portion shown in FIG. 6 comprises wooden inner material 12*a* and metal outer material 12*b*.

The following is the result of a speed test of downhill skiing performed by using skis according to the present invention. (Test)

Four skiers $M_1$, $M_2$, $M_3$ and $M_4$ wore the same kind of ski, and made three trials respectively. The approach distance was 250 m.

Speed Test km/h

| skier \ trial | First | Second | Third |
|---|---|---|---|
| $M_1$ | — | 163.667 | 180.000 |
| $M_2$ | 153.139 | 165.017 | 180.000 |
| $M_3$ | 149.254 | 163.934 | 176.527 |
| $M_4$ | 144.092 | 160.000 | 176.139 |

As apparent from the result above, by using a ski provided with air holes according to the present invention, wind resistance received by the surface of a top bend portion did not increase due to presence of the air holes even when gliding speed of the ski was more than 150 km/h, and the gliding speed at last reached 180 km/h.

What is claimed is:

1. A ski including at least a body and a top bend portion extending from one end of said body, said top bend portion being provided with a plurality of air holes passing through said top bend portion from the front to the back surface thereof and allowing air flow to pass therethrough in gliding of said ski.

2. A ski as claimed in claim 1, in which each of said air holes extends substantially in parallel with the longitudinal axis of said body of said ski.

3. A ski as claimed in claim 1, in which each of said air holes has an enlarged entrance adjacent to the front surface of said top bend portion, whereby air flow can effectively pass through said hole.

4. A ski as claimed in claim 1, in which each of said air holes has circular section.

* * * * *